US005942359A

United States Patent [19]

Kinoshita et al.

[11] Patent Number: 5,942,359

[45] Date of Patent: Aug. 24, 1999

[54] ELECTROPHOTORECEPTOR

[75] Inventors: Akira Kinoshita; Hirofumi Hayata; Toyoko Shibata; Tomoko Suzuki, all of Hino, Japan

[73] Assignee: Konica Corporation, Tokyo, Japan

[21] Appl. No.: 08/896,845

[22] Filed: Jul. 18, 1997

[30] Foreign Application Priority Data

Jul. 24, 1996 [JP] Japan ..... 8-194671
Jul. 24, 1996 [JP] Japan ..... 8-194672

[51] Int. Cl.[6] ..... G03G 5/047

[52] U.S. Cl. ..... 430/58

[58] Field of Search ..... 430/58, 59, 83

[56] References Cited

U.S. PATENT DOCUMENTS 5,384,625 1/1995 Anayama et al. ..... 430/58
5,565,288 10/1996 Watanabe et al. .
5,718,997 2/1998 Hayata et al. ..... 430/58

OTHER PUBLICATIONS

Patent Abstracts of Japan, vol. 097, No. 001, Jan. 31, 1997 of JP 08 248654A, Sep. 27, 1996.
Patent Abstracts of Japan, Vol. 097, No. 003, Mar. 31, 1997 of JP 08 305052A, Nov. 22, 1996.

*Primary Examiner*—John Goodrow
*Attorney, Agent, or Firm*—Frishauf, Holtz, Goodman, Langer & Chick, P.C.

[57] ABSTRACT

Disclosed is an electrophotoreceptor comprising a conductive substrate and provided thereon, a photoreceptive layer comprising a charge generation material, an organic electron transporting charge transport material and a binder, wherein a layer transporting charge satisfies inequality $\alpha \leqq 0.6$, said $\alpha$ being a gradient of a straight line represented by the following formula (a):

$$\Phi_{CTL}=\alpha\cdot\Phi_M+\beta \quad \text{(a)}$$

wherein $\Phi_{CTL}$ represents work function of the layer transporting charge alone obtained by measuring a contact potential difference of the layer transporting charge on a conductive electrode material; $\Phi_M$ represents work function of the conductive electrode material; and $\beta$ is a constant.

13 Claims, 6 Drawing Sheets

ELECTROPHOTORECEPTOR

FIELD OF THE INVENTION

The present invention relates to an elecltrophotoreceptor for forming an electrostatic latent image, more specifically, an electrophotoreceptor having a layer comprising an organic electron transport material.

BACKGROUND OF THE INVENTION

Conventionally, in copiers, printers, fax machines and the like to which electrophotographic technology is applied, have been widely employed organic photoreceptors according to the excellent features such as high sensitivity, small dependence on temperature and humidity, and higha speed response to a semiconductor laser beam.

In the above-mentioned electrophotoreceptors, the selection for materials is remarkably widened by utilizing function-separating compositions such that a charge is generated by one material and is transported by the other. Particularly, in organic compounds, it is possible to design a wide variety of chemical structures and excellent materials have been developed for both charge generation and charge transport.

As charge generation materials, have been proposed various organic dyes and organic pigments. For example, are known polycyclic quinone compounds represented by dibromoanthanthrone, pyrylium compounds and complexes of pyrylium compounds with polycarbonates, squarium compounds, phthalocyanine compounds, azo compounds, etc.

As charge transport materials, are known compounds having a nitrogen containing heterocyclic nucleus and the condensed ring nucleus represented by oxazole, oxadiazole, thiazole, thiadiazole, imidazole, etc., polyarylalkanes, pyrazolines, hydrazones, triarylamines, styryl compounds, styryltriphenylamines, β-phenylstyryltriphenylainines, butadiens, haxatrienes, carbazoles, etc. These charge transport materials have been capable of performing positive hole transport.

Conventionally, when the photoreceptor is prepared by combining a charge generation material with a charge transport material, the most durable photoreceptor has been obtained by utilizing a layered structure wherein a charge generation layer comprising the charge generation material is arranged on an electrode, and on the aforesaid layer, the charge transport layer comprising the charge transport material is disposed. Such the composition as mentioned above is applied to most of the present organic photoreceptors.

On the other hand, the above-mentioned charge transport material is capable of performing only positive hole transport. Therefore, in such an electrophotoreceptor, upon charging negatively the surface of the photoreceptor, operation is performed. For charging, is generally employed a corona discharging method which allows high speed operation and provides stable charging characteristics. Ozone generation is accompanied with the corona discharging. In recent years, in accordance with the high speed operation of electrophotographic processes, there has been concern on the increase in the ozone generation per unit period of time and a photoreceptor has been needed adapting to the positive corona charging process generating less ozone.

In view of the above-mentioned concern, have been developed organic photoreceptors having a layered structure wherein the charge transport layer enabling electron transport is arranged as an upper layer. As electron transport materials, have been disclosed 2,4,7-trinitrofluorenone and compounds described in Japanese Patent Publication Open to Public Inspection Nos. 206349/1989, 214866/1990 and 279582/1993, and U.S. Pat. No. 5,468,583.

However, even though these electron transport materials are utilized, in the conventional charge transport layer, there have been a serious obstacle to the charge injection characteristics from the charge generation material. Accordingly, in the light-responding operation as the electrophotoreceptor, noticeable residual potential remains so that an electric potential contrast required for forming an image has not been obtainable. Furthermore, in a practical electrophotographic process, the photoreceptor is repeatedly employed for charging and exposure. In the above-mentioned photoreceptor, when employed repeatedly, the residual potential is accumulated so that the remarkable increase in the potential is caused, which makes it impossible to utilize the photoreceptor.

SUMMARY OF THE INVENTION

An object of the present invention is to provide an electrophotoreceptor which has an electron transporting charge transport layer and low residual electric potential and can secure an image contrast.

Another object of the present invention is to provide an electrophotoreceptor which has an electron transporting charge transport layer and low residual electric potential and causes no problem due to the increase in electric potential during the repeated use.

DETAILED DESCRIPTION OF THE INVENTION

Figure 1:
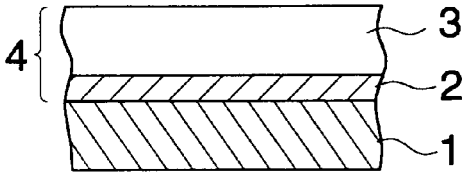
FIGS. 1(*a*) to 1(*f*) show cross-sectional views illustrating structures of the photoreceptors of the present invention.
Figure 1:
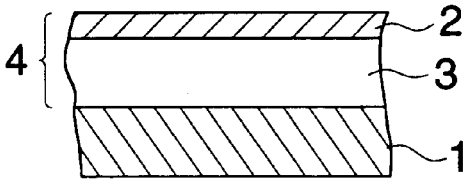
Figure 1:
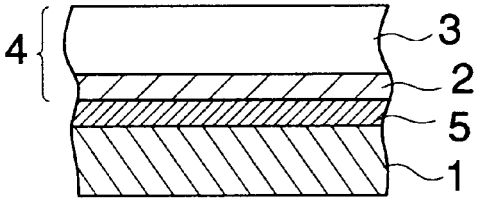
Figure 1:
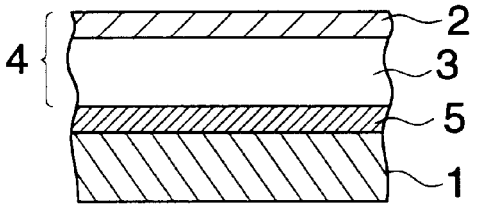
Figure 1:
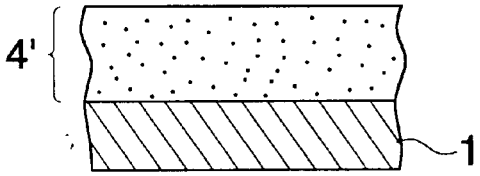
Figure 1:
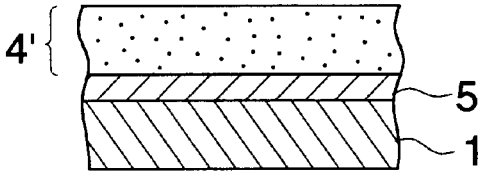

The objects of the present invention have been accomplished by the following embodiments.

1. an electrophotoreceptor comprising an electron transporting charge transport layer containing a binder and an organic transport material, the charge transport layer satisfying inequality $\alpha \leqq 0.6$, said $\alpha$ being a gradient of a straight line linearly approximated by the following formula (a):

$$\Phi_{CTL}=\alpha\cdot\Phi_M+\beta \qquad \text{(a)}(\alpha,\ \beta\text{: constant})$$

wherein $\Phi_{CTL}$ represents work function of the charge transport layer alone obtained by measuring a contact potential difference of the charge transport layer provided on a conductive electrode material; and $\Phi_M$ represents work function of the conductive electrode material.

2. the electrophotoreceptor of item 1, wherein a charge generation layer and the charge transport layer are provided in a layered structure on the substrate.

3. An electrophotoreceptor comprising a conductive substrate and provided thereon, a photoreceptive layer comprising a charge generation material, an organic electron transporting charge transport material and a binder, wherein a layer transporting charge satisfies inequality $\alpha \leqq 0.6$, said $\alpha$ being a gradient of a straight line represented by the following formula (a):

$$\Phi_{CTL}=\alpha\cdot\Phi_M+\beta \quad (a)$$

wherein $\Phi_{CTL}$ represents work function of the layer transporting charge alone obtained by measuring a contact potential difference of the layer transporting charge on a conductive electrode material; $\Phi_M$ represents work function of the conductive electrode material; and $\beta$ is a constant.

4. The electrophotoreceptor of item 3, wherein the photoreceptive layer contains a charge generation material and the electron transporting charge transport material in admixture.

5. The electrophotoreceptor of item 3, wherein the photoreceptive layer comprises a charge generation layer containing a charge generation material and the charge transport layer containing an electron transporting charge transport material provided in a layered structure on the substrate.

6. The electrophotoreceptor of item 5, wherein the charge generation layer and the charge transport layer are provided in that order on the substrate.

7. An electrophotoreceptor comprising a conductive substrate and provided thereon, a photoreceptive layer comprising a charge generation material, an organic electron transport material and a binder, wherein a layer transporting charge satisfies inequality $\alpha \leqq 0.2$ in a specific range of $\Phi_M$, said $\alpha$ being a gradient of a straight line represented by the following formula (a):

$$\Phi_{CTL}=\alpha\cdot\Phi_M+\beta \quad (a)$$

wherein $\Phi_{CTL}$ represents work function of the layer transporting charge alone obtained by measuring a contact potential difference of the layer transporting charge on a conductive electrode material; $\Phi_M$ represents work function of the conductive electrode material; and $\beta$ is a constant.

8. The electrophotoreceptor of item 7, wherein the photoreceptive layer contains a charge generation material and the electron transporting charge transport material in admixture.

9. The electrophotoreceptor of item 7, wherein the photoreceptive layer comprises a charge generation layer containing a charge generation material and the charge transport layer containing an electron transporting charge transport material provided in a layered structure on the substrate.

10. The electrophotoreceptor of item 9, wherein the charge generation layer and the charge transport layer are provided in that order on the substrate.

11. The electrophotoreceptor of item 3, wherein the layer transporting charge has a work function satisfying inequality $\alpha \leqq 0.6$ in the $\Phi_M$ range of 3.6 to 6.0 (eV).

12. The electrophotoreceptor of item 3, wherein the conductive substrate is made of a metal having $\Phi_M$ of 3.6 to 6.0 (eV).

13. The electrophotoreceptor of item 7, wherein the layer transporting the charge has a work function satisfying inequality $\alpha \leqq 0.6$ in the $\Phi_M$ range of 3.6 to 6.0 (eV).

14. The electrophotoreceptor of item 7, wherein the conductive substrate is made of a metal having $\Phi_M$ of 3.6 to 6.0 (eV).

In order to accomplish the objects of the present invention by improving the charge injection characteristics to the charge transport layer enabling electron transport, inventors of the present invention have found that the work function of the charge transport layer plays a big role.

When the contact potential difference is measured to obtain the work function of the charge transport layer alone, a phenomenon has been found such that the work function of the charge transport layer varies according to the change in the conductive electrode material on which the charge transport layer is provided. The inventors paid attention at the time to the work function of the conductive electrode material on which the charge transport layer is provided and have found that the objects of the present invention are accomplished by utilizing the charge transport layer having the relationship of $\alpha \leqq 0.6$ or the charge transport layer having the relationship of $\alpha \leqq 0.2$ in a specific range of $\phi_M$ together with the electrode having the work function $\phi_M$ belonging to the range (in the formula, $\alpha$ and $\beta$ are constants.).

$$\phi_{CTL}=\alpha\cdot\phi_M+\beta \quad (a)$$

The above formula (a) is obtained by means of a least-squares method.

The charge transport layer herein referred to implies a layer with charge transporting capability or a layer with charge transporting capability comprising a charge generation material. That is, a layer comprising a charge generation material and a charge transport material in admixture, is called "charge transporting layer". The same applies to the charge generation layer herein referred to. These layer are called "charge transporting layer" or "charge generation layer" according to the main functions of their layers.

On the cause of the formation of the remarkably high residual electric potential in the photoreceptor utilizing the electron transporting charge transport layer, the inventors have confirmed that there is an obstacle in a process wherein electrons generated in the charge generation layer during the light response of the photoreceptor is injected into the charge transport layer.

The injection of the electrons from the charge generation layer to the charge transport layer is accomplished by the transfer of the electrons from the electron conduction level of a charge generation material to that of a charge transport material. It is possible to estimate the electron conduction levels of these organic compounds by the measurement of reduction potential. Generally, the reduction potential of the electron transport material employed in the organic photoreceptor is between −0.4 to −1 V against a Ag/AgCl electrode. From these potentials it is possible to estimate that the electron conduction level of the electron transport material is located at the position about from −3.9 to −4.3 eV. The electron conduction level of the charge generation material is located approximately in the range of −3 to −4 eV and therefore, it is energetically located at the higher level than the electron conduction level of the charge transport material. Namely, as far as both materials are compared in terms of each electronic energy level, it is found that there is no energetic barrier for the electron injection from the charge generation material to the charge transport material.

On the other hand, it has been known that in the electrophotoreceptor comprising a conductive supporting substrate (electrode), the proper Fermi level of the charge generation layer is different from that of the charge transport layer, when they are seperately present, and in the photoreceptor composition wherein those are closely contacted, the potential of each layer varies in a direction so that each of the Fermi levels coincides as a whole. Namely, it should be considered in such a way that the electron conduction levels in the photoreceptor of the charge generation material and the charge transport material are different from those of the materials separately present and are decided through the potential change due to the contact.

In a practical photoreceptor, as compared to the charge generation layer and the charge transport layer, the electron capacity of the electrode is overwhelmingly large and the Fermi level as a whole coincides with the Fermi level of the electrode at equilibrium. Further, in the photoreceptor wherein the electrode, the charge generation layer and the charge transport layer are layered in this order, as described, for example, in "Japan Hardcopy'94 Preprints pages 229 to 232", the charge transport material penetrates deeply into the charge generation layer and is present on the concentration high enough in the interface of the electrode. Accordingly, it will be possible to mention that the electronic energy level is decided by potential equilibrium with the electrode not only for the charge generation layer but also for the charge transport layer in the photoreceptor.

Regarding a problem on the charge injection process in the photoreceptor comprising the electron transporting charge transport layer, the inventors paid special attention to the electron energy level of the charge transport layer in the contact equilibrium with the electrode. As a means to measure the contact equilibrium, there is a measurement of a contact potential difference. In the measurement of the contact potential difference, the potential difference generated by the contact with a specific metal (gold is utilized as a representative metal.) is measured and the work function of a layer to be measured is decided. For the measurement, a method generally termed a Kelvin method is employed. The Kelvin method and deciding method for the work function are described in detail in "Shin Jikken Kagaku Koza 18—Kaimen to Koroido—(New Experimental Chemistry Lecture 18—Interface and Colloid—)" Nihon Kagaku Kai Hen (Edited by Japan Chemical Society) pages 181 to 192.

When deciding the work function of the charge transport layer, a sample is prepared in such a way that the charge transport layer is arranged on various electrode materials and employing a gold electrode as a counter electrode, is measured a potential difference between the surface of the charge transport layer and the surface of the gold electrode (counter electrode). The charge transport layer is in contact with the gold electrode via the electrode of the sample. Originally, electrons are fully transferred from the higher Fermi level to the lower Fermi level and the equilibrium is attained. In such a case, being independent of the metal of the sample electrode, the contact potential difference between the charge transport layer and the gold electrode becomes constant. Accordingly, the work function of the charge transport layer should be constant. However, in the practical measurement results, depending on the work function of the sample electrode, the work function of the charge transport layer varies. These facts are disclosed, for example, in "Japan Hardcopy'90 Fall Meeting Preprints pages 80 to 83", etc. This indicated that the practical equilibrium of the charge transport layer with the sample electrode is different from that achieved by the ideal electron transfer. It is noted as a behavior due to the properties of the charge transport layer.

The relationship between the charge transport layer and the sample electrode obtained by the above-mentioned measurement of the contact potential difference may just suggest the relationship between the charge transport layer and the electrode in the electrophotoreceptor. Accordingly, the correlation with the charge injection properties is implied and moreover, the correlation with the residual potential properties of the photoreceptor is also implied.

In view of the foregoing, with a problem on the residual potential in the photoreceptor comprising the electron transporting charge transport layer, the inventors have measured the contact potential difference of the charge transport layer itself and have investigated the relationship between the work function $\phi_{CTL}$ of the charge transport layer and the work function $\phi_M$ of the sample electrode. As a result, in the electron transporting charge transport layer, both are confirmed to have an approximately linear relationship.

In the conventional electron transporting charge transport layer gradient $\alpha$ has varied within the range of 0.65 to 1.

However, in the course of the investigation, it has been found in a specific combination of an electron transport material and a binder that the gradient can hold the relationship of $\alpha \leqq 0.6$. Surprisingly, it has been found that in the photoreceptor comprising the charge transport layer having such a relationship as $\alpha \leqq 0.6$, the electron injection properties from the charge transport layer are improved and the residual potential is lowered.

In the electrophotoreceptor prepared by combining the electron transporting charge transport layer having the gradient of $\alpha \leqq 0.2$ in a specific range of the work function $\phi_M$ with an electrode having the work function $\phi_M$ giving a $\alpha \leqq 0.2$, excellent features are obtained such that the residual potential is almost eliminated and no increase in the residual potential when repeatedly used. Thus, the objects of the present invention have been accomplished.

The lower limit of $\alpha$ is zero, but may be $\alpha<0$ according to error of measurement. In the latter case, the lower limit of $\alpha$ may be, for example, −0.1. The $\Phi_M$ of the electrode, which is used as the conductive substrate of the electrophotoreceptor, is in the range of preferably 3.6 to 6 eV.

The charge transport layer in the invention preferably has a work function satisfying inequality a $\alpha \leqq 0.6$ in the $\Phi_M$ range of 3.6 to 6.0 eV in the contact potential difference measurement, the $\Phi_M$ being the work function of the electrode on which the charge transport layer is provided.

No electron transport material is particularly limited which can be employed to constitute the electron transporting charge transport layer in the present invention. However, materials represented by formulas (A) to (D) are preferably employed. Illustrative examples are shown in the following.

formula (A)

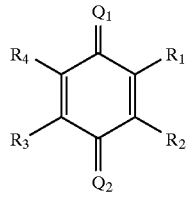

formula (B)

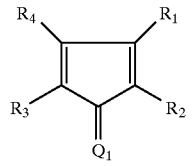

-continued formula (C)

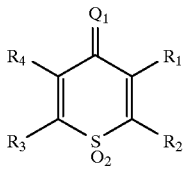

formula (D)

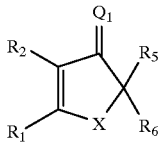

Wherein X represents $>SO_2$ or $>C{=}Q_2$, and $Q_1$ and $Q_2$ each represent $=O$, $=S$, $=N{-}R_7$ or $=C(Z_1)(Z_2)$.

Wherein $R_1$ to $R_7$ each represent a hydrogen atom, halogen, cyano, a substituted vinyl group, or a substituted or unsubstituted alkyl, aryl or heterocylclic grolp. $R_1$ and $R_2$, and $R_3$ and $R_4$ each combination may form an aromatic ring or an aliphatic ring upon forming a bond and $R_5$ and $R_6$ together may have a structure of $-N-R_7$ or $=C(R_8)(R_9)$ in which $R_8$ and $R_9$ independently represent a hydrogen atom, halogen, cyano, a substituted vinyl group, or a substituted or unsubstituted alkyl, aryl or heterocyclic group. Further, $Z_1$ and $Z_2$ each represent an electron attractive group.

The substituent of the substituted vinyl group includes phenyl, cyano and alkoxycarbonyl. The alkyl group includes an alkyl group having 1 to 20 carbon atoms. The aryl group includes phenyl and naphthyl. The heterocyclic group includes pyridyl, thiofuranyl, quinolinyl and oxazolyl. The substituent of the alkyl, aryl or heterocyclic group includes alkoxy, vinyl, phenyl, alkyl, halogen, trifluoromethyl, cyano, amino, alkylamino, arylamino, nitro, alkoxycarbonyl, acyl, styryl, alkylcarbamido, alkylsulfonamido, and carbamoyl. The electron attractive group includes a cyano, nitro, trifluoromethyl, alkoxycarbonyl, acyl, aryloxycarbonyl or sulfonyl group, and phenyl or naphthyl each having these group.

Compound examples represented by formula (A)
| No. | $Q_1$ | $Q_2$ | $R_1$ | $R_2$ | $R_3$ | $R_4$ |
|---|---|---|---|---|---|---|
| A-1 | =O | =O | H | 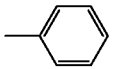 | 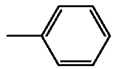 | H |
| A-2 | =O | =O | H | 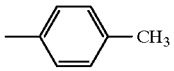 | 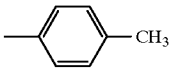 | 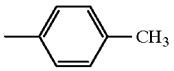 |
| A-3 | =O | =O | 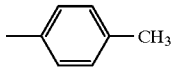 | 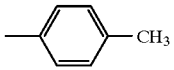 | 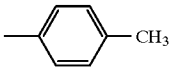 | 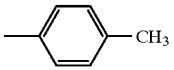 |
| A-4 | =O | =O | Cl | 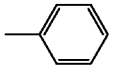 | 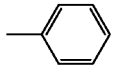 | H |
| A-5 | =N—CN | =O | H | 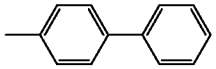 | 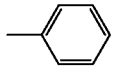 | H |
| A-6 | =N—CN | =O | H | 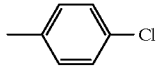 | 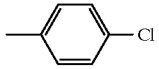 | H |
| A-7 | 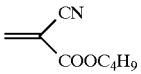 | =O | H | 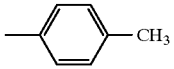 | 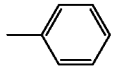 | H |
| A-8 | 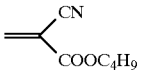 | =O | H | 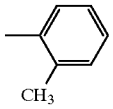 | 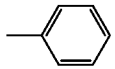 | H |

-continued
| | | | | | | |
|---|---|---|---|---|---|---|
| A-9 | 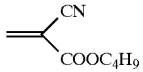 | =O | H | 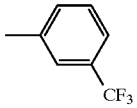 | 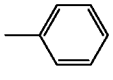 | H |
| A-10 | 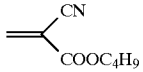 | =O | H | 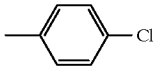 | 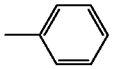 | H |
| A-11 | 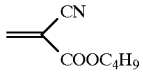 | =O | H | 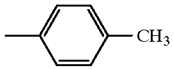 | 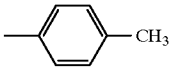 | H |
| A-12 | 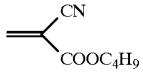 | =O | H | 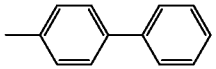 | 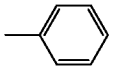 | H |
| A-13 | 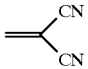 | =O | H | 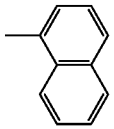 | 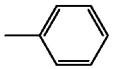 | H |
| A-14 | 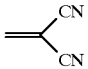 | =O | H | $-C_4H_9$ | $-C_4H_9$ | H |
| A-15 | 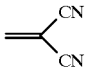 | =O | H | 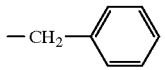 | 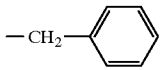 | H |
| A-16 | 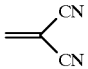 | =O | H | 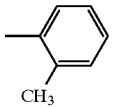 | 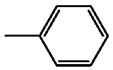 | H |

-continued
| | | | | | | |
|---|---|---|---|---|---|---|
| A-17 | 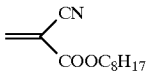 | =O | H | 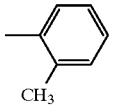 | 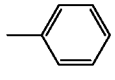 | H |
| A-18 | 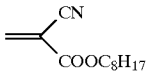 | =O | H | 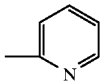 | 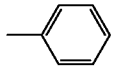 | H |
| A-19 | 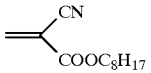 | =O | H | 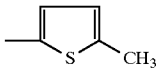 | 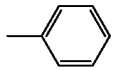 | H |
| A-20 | 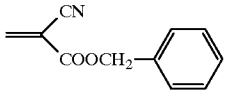 | =O | H | 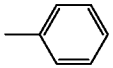 | 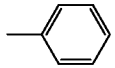 | H |
| A-21 | 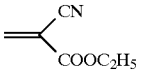 | =O | H | 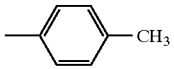 | 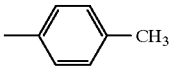 | H |
| A-22 | 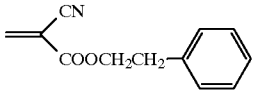 | =O | H | 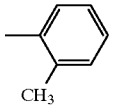 | 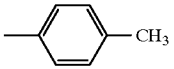 | H |
| A-23 | 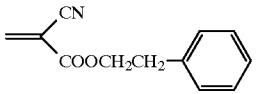 | =O | H | 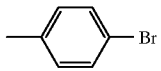 | 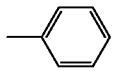 | H |
| A-24 | 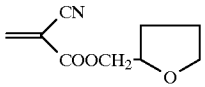 | =O | H | 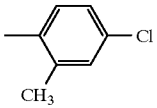 | 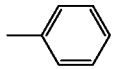 | H |

-continued
| | | | | | | |
|---|---|---|---|---|---|---|
| A-25 | 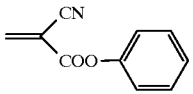 | =O | H | 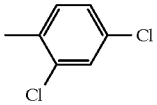 = | 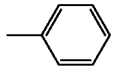 = | H |
| A-26 | 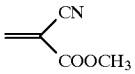 | =O | H | 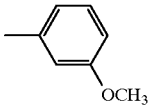 = | 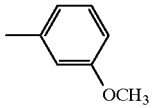 = | H |
| A-27 | 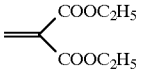 | =O | H | 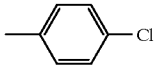 = | 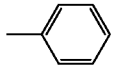 = | H |
| A-28 | 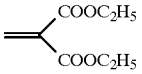 | =O | H | —$CH_3$ | —$CH_3$ | H |
| A-29 | 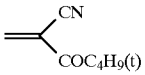 | =O | H | 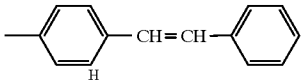 = | 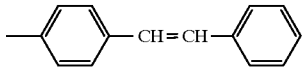 = | H |
| A-30 | 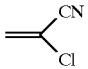 | =O | H | 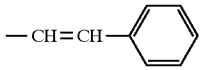 = | 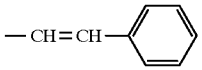 = | H |
| A-31 | 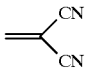 | 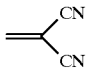 | H | —$CH_3$ | H | —$CH_3$ |
| A-32 | 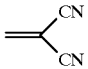 | 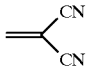 | H | H | H | H |
| A-33 | =O | =O | | 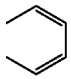 = | —$CH_3$ | H |

-continued
| | | | | | |
|---|---|---|---|---|---|
| A-34 | =O | =O | 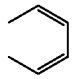 = | 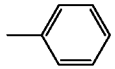 = | H |
| A-35 | =O | =O | 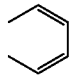 = | 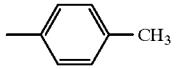 = | 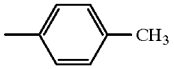 = |
| A-36 | =O | =O | 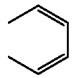 = | 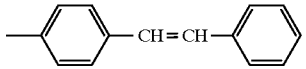 = | H |
| A-37 | =O | =O | 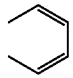 = | 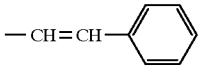 = | H |
| A-38 | =N—CN | =O | 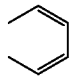 = | 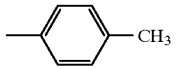 = | H |
| A-39 | =N—CN | =O | 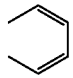 = | 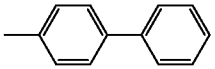 = | H |
| A-40 | =N—CN | =O | 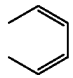 = | 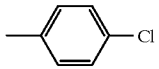 = | H |
| A-41 | =N—CN | =N—CN | 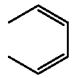 — | 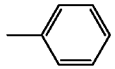 — | H |

-continued
| | | | | | |
|---|---|---|---|---|---|
| A-42 | =N—CN | =N—CN | 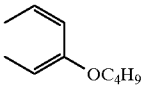 | H | H |
| A-43 | =N—CN | =N—CN | 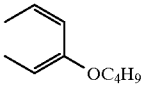 | 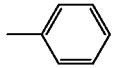 | H |
| A-44 | 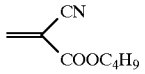 | =O | 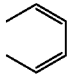 | 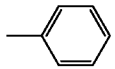 | H |
| A-45 | 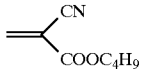 | =O | 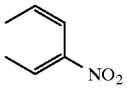 | 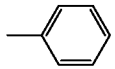 | H |
| A-46 | 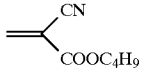 | =O | 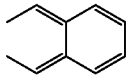 | 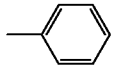 | H |
| A-47 | 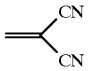 | =O | 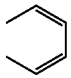 | 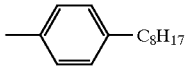 | H |
| A-48 | 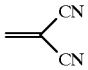 | =O | 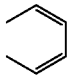 | 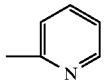 | H |
| A-49 | =O | =O | 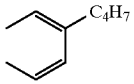 | 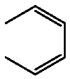 | |

-continued
| | | | | |
|---|---|---|---|---|
| A-50 | =O | =O | 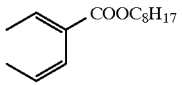 | 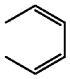 |
| A-51 | =O | =O | 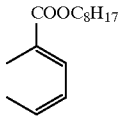 | 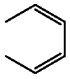 |
| A-52 | =N—CN | =O | 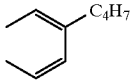 | 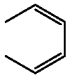 |
| A-53 | =N—CN | =O | 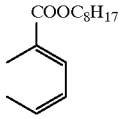 | 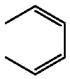 |
| A-54 | =N—CN | =O | 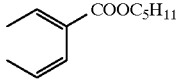 | 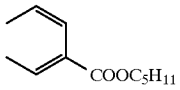 |
| A-55 | =N—CN | =N—CN | 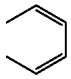 | 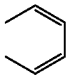 |
| A-56 | 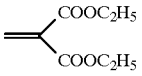 | =O | 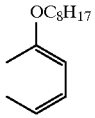 | 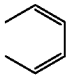 |
| A-57 | 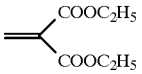 | 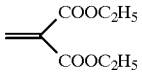 | 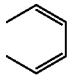 | 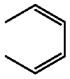 |

-continued
| | | | | |
|---|---|---|---|---|
| A-58 | =O | =O | 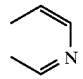 | 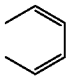 |
| A-59 | =O | =O | 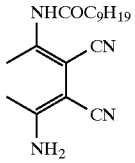 | 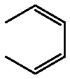 |
Compound examples represented by formula (B)
| No. | $Q_1$ | $R_1$ | $R_2$ | $R_3$ | $R_4$ |
|---|---|---|---|---|---|
| B-1 | =O | 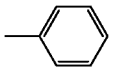 | 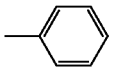 | 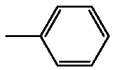 | 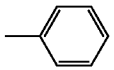 |
| B-2 | =S | 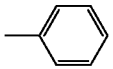 | 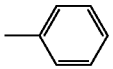 | 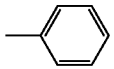 | 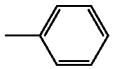 |
| B-3 | =N—CN | 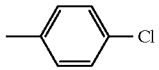 | 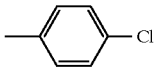 | 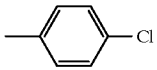 | 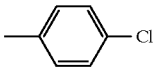 |
| B-4 | =N—CN | 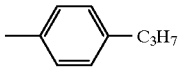 | H | H | 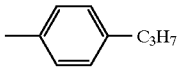 |
| B-5 | =N—CN | 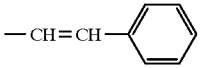 | H | H | 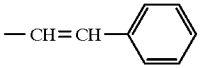 |

-continued
| | | | | | |
|---|---|---|---|---|---|
| B-6 | 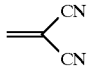 | 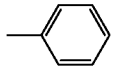 | 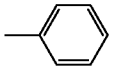 | 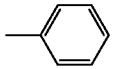 | 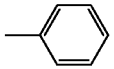 |
| B-7 | 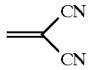 | 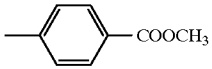 | 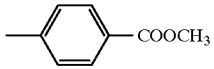 | 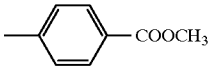 | 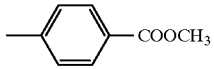 |
| B-8 | 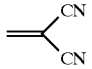 | 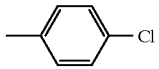 | 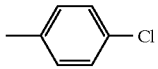 | 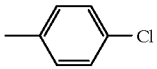 | 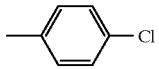 |
| B-9 | 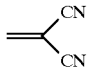 | 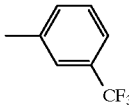 | 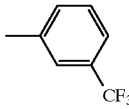 | 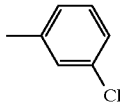 | 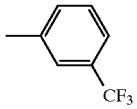 |
| B-10 | =O | 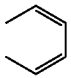 | | 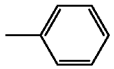 | 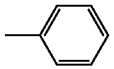 |
| B-11 | =O | 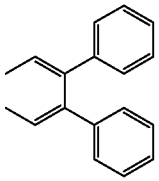 | | 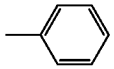 | 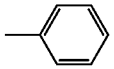 |
| B-12 | 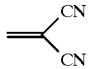 | 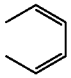 | | 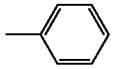 | 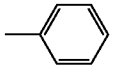 |
| B-13 | 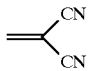 | 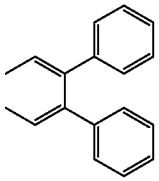 | | 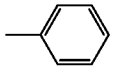 | 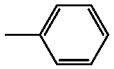 |

-continued
| | | | | |
|---|---|---|---|---|
| B-14 | 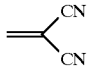 | 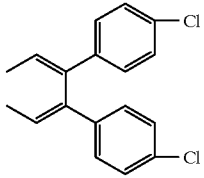 | 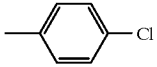 | 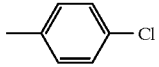 |
| B-15 | 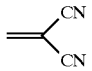 | 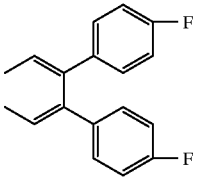 | 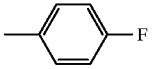 | 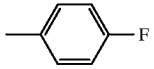 |
| B-16 | =N—CN | 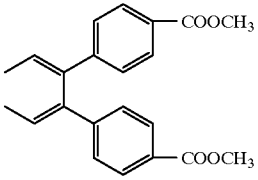 | 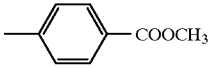 | 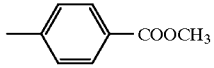 |
| B-17 | =N—CN | 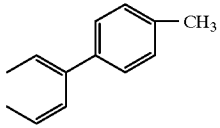 | 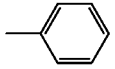 | 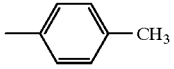 |
| B-18 | =N—CN | 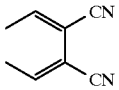 | 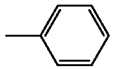 | 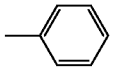 |
| B-19 | 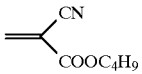 | 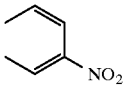 | 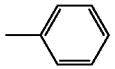 | 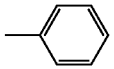 |

-continued
| | | | | |
|---|---|---|---|---|
| B-20 | 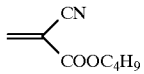 | 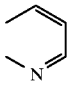 | 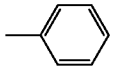 | 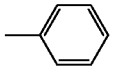 |
| B-27 | =O | 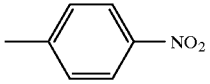 | 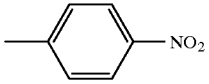 | |
| B-28 | 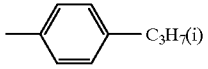 | 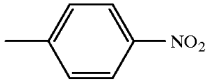 | 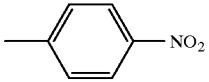 | |
| B-29 | 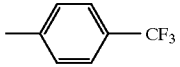 | 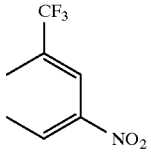 | 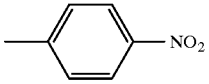 | |
| B-30 | 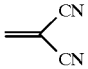 | 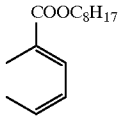 | 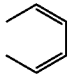 | |
| B-31 | 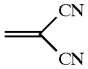 | 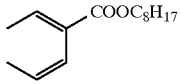 | 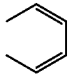 | |
| B-32 | 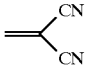 | 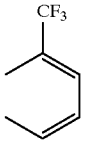 | 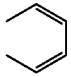 | |

-continued
Compound examples represented by formula (C)
| No. | $Q_1$ | $R_1$ | $R_2$ | $R_3$ | $R_4$ |
|---|---|---|---|---|---|
| C-1 | =O | H | 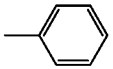 | 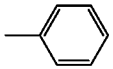 | H |
| C-2 | =O | —$COOC_4H_9$ | 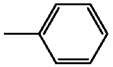 | 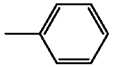 | —$COOC_4H_9$ |
| C-3 | 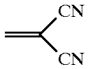 | H | 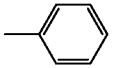 | 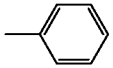 | H |
| C-4 | 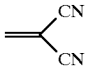 | H | 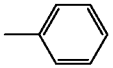 | 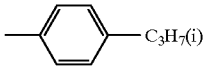 | H |
| C-5 | 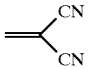 | H | 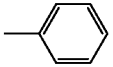 | 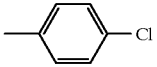 | H |
| C-6 | 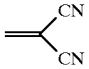 | H | 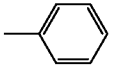 | 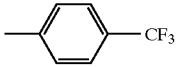 | H |
| C-7 | 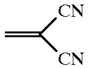 | H | 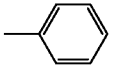 | 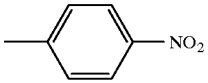 | H |
| C-8 | =N—CN | H | 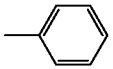 | 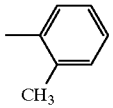 | H |

-continued
| | | | | | |
|---|---|---|---|---|---|
| C-9 | =N—CN | H | 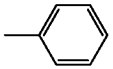 — | 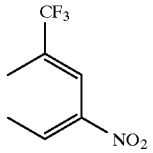 — | H |
| C-10 | 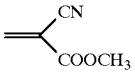 | H | 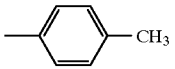 | 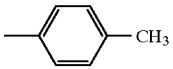 | H |
| C-11 | 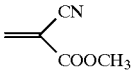 | H | 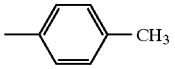 | 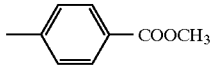 | H |
Compound examples represented by formula (D)
| No. | $Q_1$ | X | $R_1$ | $R_2$ | $R_5$ | $R_6$ |
|---|---|---|---|---|---|---|
| D-1 | =O | 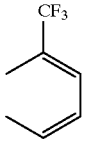 = | 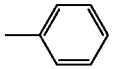 = | 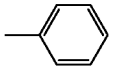 = | 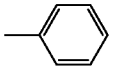 = | —$CH_3$ |
| D-2 | 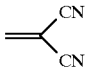 | 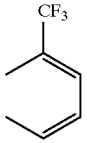 | 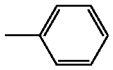 | 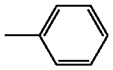 | —$CH_3$ | —$CH_3$ |
| D-3 | 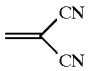 | 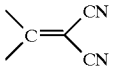 | 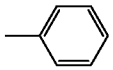 | 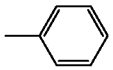 | 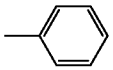 | 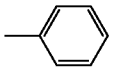 |
| D-4 | 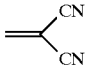 | 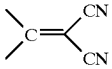 | 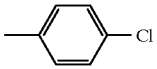 | 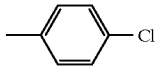 | —$CH_3$ | 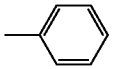 |

-continued
| | | | | | |
|---|---|---|---|---|---|
| D-5 | 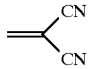 | 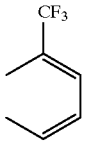 | 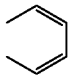 | H | 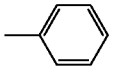 |
| D-6 | 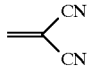 | 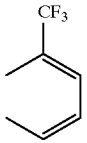 | 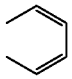 | | 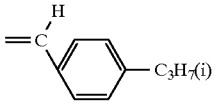 |
| D-7 | 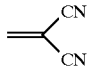 | 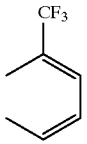 | 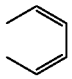 | | 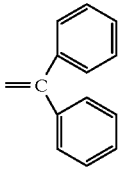 |
| D-8 | =N—CN | 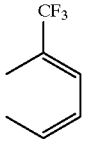 | 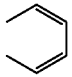 | —$CH_3$ | —$CH_3$ |
| D-9 | =N—CN | 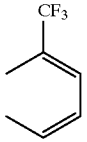 | 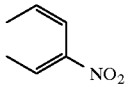 | H | —$C_4H_9$ |
| D-10 | 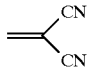 | 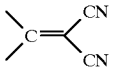 | 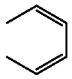 | H | 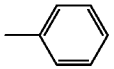 |
| D-11 | 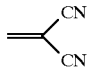 | 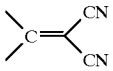 | 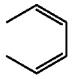 | H | —$CH_2CH{=}CH_2$ |

-continued
| | | | | | |
|---|---|---|---|---|---|
| D-12 | 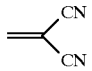 | 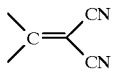 | 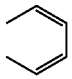 | —$CH_3$ | 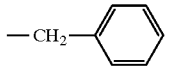 |
| D-13 | 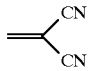 | 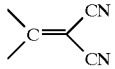 | 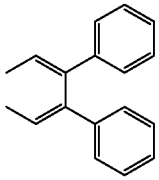 | 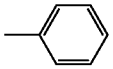 | H |
| D-14 | 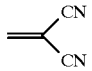 | 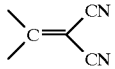 | 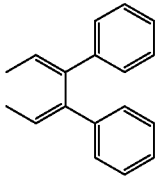 | 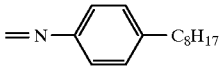 | |
| D-15 | 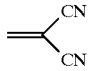 | 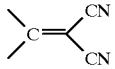 | 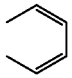 | 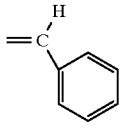 | |
| D-16 | =O | 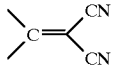 = | 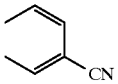 = | 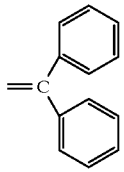 = | |

The photoreceptive layer of the photoreceptor of the invention may be a layer containing a charge transport material and an electron transporting charge transport material in admixture, or a charge transport layer containing a charge transport material and a charge transport layer containing an electron transporting charge transport material in a layered structure.

It is preferred that the photoreceptor of the present invention is composed of a layered structure wherein the charge generation layer is a lower layer and the charge transport layer is an upper layer. However, the features of the present invention is effected not only by the above-mentioned structure but also by other various structures. FIGS. 1(*a*) to 1(*f*) illustrate representative structures.

In FIG. 1(*a*), on a conductive supporting substrate 1, a charge generation layer 2 is formed and on the resulting layer a charge transport layer 3 is layered to form a photoreceptive layer 4. In FIG. 1(*b*), reversing the charge generation layer 2 and the charge transport layer 3, the photoreceptive layer 4 is formed on the substrate 1. In FIG. 1(*c*), between the photoreceptive layer 4 and the conductive supporting substrate 1 employed as the layered structure in FIG. 1(*a*) is formed an intermediate layer 5. In FIG. 1(*d*), in the layered structure of FIG. 1(*b*), the intermediate layer 5 is formed between the photoreceptive layer 4 and the conductive supporting substrate 1. In FIG. 1(*e*), is formed a photoreceptive layer 4' comprising a charge generation material and a charge transport material on the substrate 1. In FIG. 1(*f*), is formed an intermediate layer 5 between the photoreceptive layer 4' and the conductive supporting substrate 1. In the structures of FIGS. 1(*a*) to 1(*f*), on the uppermost layer, a protective layer can be arranged.

As the conductive supporting substrate (electrode), in addition to a metal plate and a metal drum (for example, an aluminum plate or drum), can be employed compositions wherein a conductive polymer, a conductive compound such as indium oxide, etc., or a thin layer metal such as aluminum, palladium, etc. is arranged on a substrate such as paper, plastic film, etc. by means of coating, sputtering, evaporation, lamination and the like.

In the preparation of the photoreceptive layer comprising a charge transport layer and a charge generation layer, are employed a coating and drying method wherein a coating solution prepared in advance is coated by a dip coating, spray coating, bar coating, roll coating, blade coating, applicator coating, etc. and a vacuum evaporation method. The charge generation layer coating solution can be prepared by dispersing finely a charge generation material alone or with a binder and additives into a suitable dispersion medium by a dispersing apparatus such as an ultrasonic dispersing machine, a ball mill, a sand mill, a homogenizing mixer, etc. The charge transport layer coating solution is generally prepared by dissolving a charge transport material with a suitable binder into a solvent and the resulting solution is added with additives as required.

The solvents employed at the coating include, for example, acetone, methyl ethyl ketone, cyclohexanone, tetrahydrofuran, dioxane, ethyl acetate, butyl acetate, methylcellosolve, ethylcellosolve, ethylene glycol dimethyl ether, toluene, xylene, acetophenone, chloroform, dichloromethane, dichloroethane, trichloroethane, methanol, ethanol, propanol, butanol, etc.

The binders which can be employed for the preparation of the charge generation layer and the charge transport layer include, for example, compounds in the following.

| | |
|---|---|
| Polycarbonate | Polycarbonate Z resin |
| Acryl resin | Methacryl resin |
| Polyvinyl chloride | Polyvinylidene chloride |
| Polystyrene | Styrene-butadiene copolymer |
| Polyvinyl acetate | Polyvinyl formal |
| Polyvinyl butyral | Polyvinyl acetal |
| Polyvinyl carbazole | styrene-alkyd resin |
| Silicone resin | Silicone-alkyd resin |
| Polyester | Phenol resin |
| Polyurethane | Epoxy resin |

Vinylidene chloride-acrylonitrile copolymer
Vinyl chloride-vinyl acetate copolymer
Vinyl chloride-vinyl acetate-maleic anhydride copolymer The electron transport material content of the charge transport layer is preferably 5 to 75 weight %, and more preferably 10 to 60 weight %. The ratio of the electron transport material to the binder in the charge transport layer is preferably from 1/20 to 3, and more preferably from 1/10 to 2 by weight. The charge generation material content of the charge generation layer is preferably 10 to 90 weight %, and more preferably 30 to 85 weight %.

The ratio of the charge generation material to the binder is preferably from 1/9 to 9/1 by weight and more preferably from 1/2 to 6/1 by weight.

The thickness of the charge generation layer is generally 0.01 to 20 $\mu$m and preferably 0.05 to 5 $\mu$m. The thickness of the charge transport layer is 1 to 100 $\mu$m and preferably 5 to 40 $\mu$m.

As the binders incorporated in the intermediate layer, protective layer, etc. can be employed those which are illustrated for the above-mentioned charge generation layer and charge transport layer. In addition, a polyamide resin, a nylon resin, an ethylene-based resin, such as an ethylene-vinyl acetate copolymer, an ethylene-vinyl acetate-maleic anhydride copolymer, polyvinyl alcohol, cellulose derivatives and the like are useful. Furthermore, curing type binders such as melamine, epoxy, isocyanate, etc. can be employed which utilize heat curing and chemical curing.

In order to improve potential characteristics, shelf life, durability and environment dependence, various additives can be added to the above-mentioned photoreceptive layer.

Example

In the following, with the reference to examples, the present invention is explained in detail. It should be noted that the present invention is not limited by examples herein. Further, "parts" hereinunder are by weight, unless otherwise indicated.

Measurement of Contact Potential Difference and Plotting of Work Function

Samples for measurements were prepared by spin coating a charge transport layer coating solution on each of electrodes composed of palladium (Pd), indium tin oxide (ITO), nickel-chromium alloy (Ni-Cr), titanium (Ti), aluminum (Al), aluminum-chromium alloy (Al-Cr), etc., followed by drying. The contact potential difference of each sample was measured using the Kelvin method under ambient atmosphere. The work function $\phi_{CTL}$ of the charge transport layer thus obtained was plotted versus the corresponding work function $\phi_M$ of sample electrode (regarding the results, refer to FIGS. 2(*a*) to 2(*e*)).

Evaluation 1

The evaluation on the electrophotoreceptors was conducted using the Electrostatic Copying Test Apparatus "EPA-8100" (manufactured by Kawaguchi Denki Co., Ltd.). At first, a sample was subjected to +6 kV corona discharging. After being left alone for 5 seconds in the dark, the surface potential Vi (V) was obtained. The sample was then exposed to a white light having an illumination intensity of 10 lux for 10 seconds and further to a light of 200 lux for 2 seconds. The surface potential was then measured as a residual potential Vr (V).

Example 1

A charge transport layer coating solution was prepared by dissolving 1 part of the electron transport material (A-7) and 1.3 parts of each of the following binder resins (a) to (e) in 7 parts of tetrahydrofuran (hereinafter, referred to as THF).

Figure 2:
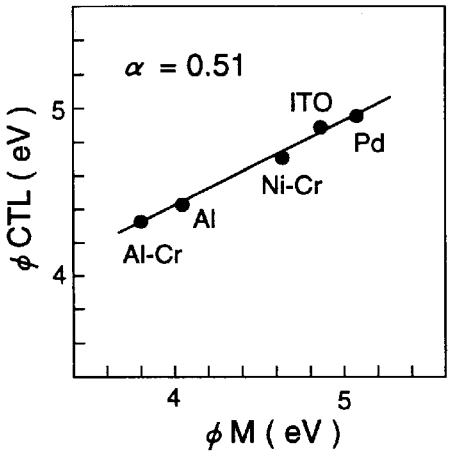
FIGS. 2(*a*) to 2(*e*) show graphs illustrating the relationship between the work function $\phi_{CTL}$ of the charge transport layer and the work function $\phi_M$ of the sample electrode.
Figure 2:
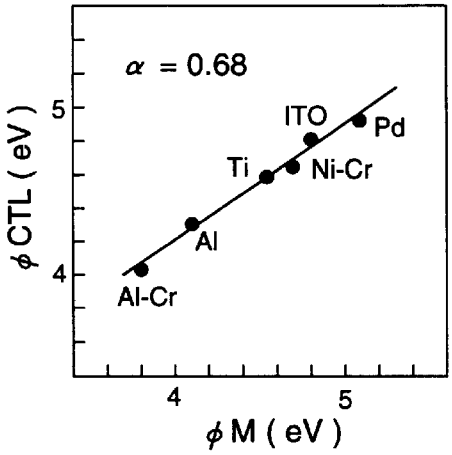
Figure 2:
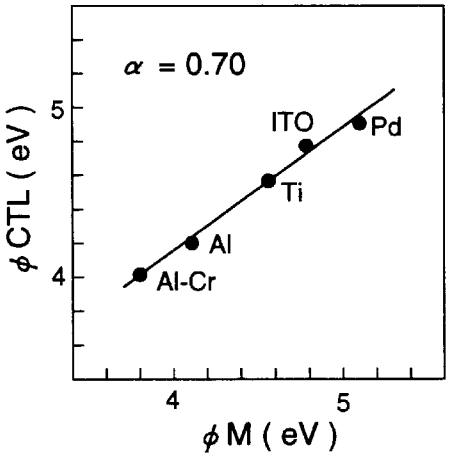
Figure 2:
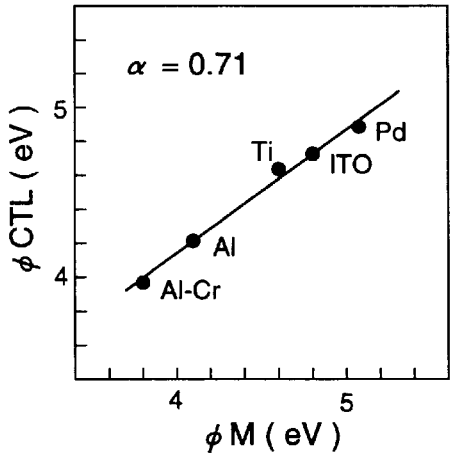
Figure 2:
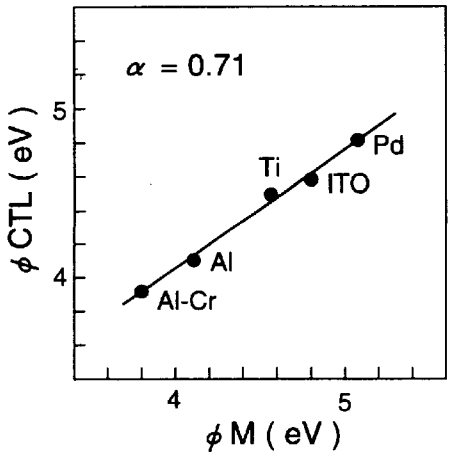

With the use of the above-mentioned solutions, the contact potential difference of each of the charge transport layers was measured and the work functions obtained were plotted as shown in FIGS. 2(*a*) to (*e*).

(a) Polystyrene "STYRON 679" (manufactured by ASAHI DAU INDUSTRY CO., LTD.)

(b) Polycarbonate "IUPILON Z-200" (manufactured by MITSUBISHI GAS CHEMICAL CO., INC.)

(c) Polyarylate "U-100" (manufactured by UNITIKA LTD.)

(d) Polyester "VYLON 200" (manufactured by TOYOBO CO., LTD.)

(e) Polymethylmethacrylate "ELVASITE-2010" (manufactured by Dupon Co. Ltd.)

On the other hand, on an aluminum deposited PET film, was coated using a wire bar a dispersion which was prepared by dispersing in a sand mill a mixture consisting of 1 part of titanylphthalocyanine having peaks at 9.5°, 24.1° and 27.2° of Bragg angle 2θ in the X-ray diffraction, 0.5 part of silicone-butyral resin and 50 parts of methyl isopropyl ketone as a dispersion medium, and a charge generation layer having a thickness of 0.4 μm was prepared. On the charge generation layer, each of the above-mentioned charge transport layer coating solutions was then coated using a doctor blade and dried to form a charge transport layer having a thickness of 20 μm. Thus, photoreceptor samples were prepared. The samples obtained were termed 1a through 1e, respectively. The resulting samples were evaluated according to the Evaluation 1. The results are tabulated in Table 1.

TABLE 1

| Sample | α of Charge Transport Layer | $V_i$ (V) | $V_r$ (V) |
|---|---|---|---|
| Sample 1a | 0.51 | 920 | 22 |
| Sample 1b | 0.68 | 883 | 65 |
| Sample 1c | 0.70 | 795 | 78 |
| Sample 1d | 0.71 | 844 | 63 |
| Sample 1e | 0.71 | 780 | 94 |

According to FIGS. 2(*a*) to 2(*e*) and the results in Table 1, in the only case of the polystyrene binder employed in (a), the gradient α of the work function plotting is 0.6 or less and the remarkable decrease in the residual potential of the photoreceptor is confirmed.

Example 2

A charge transport layer coating solution was prepared by dissolving 1 part of each of electron transport materials (A-59), (A-52) and (D-11) and 4 parts of a polyarylate resin U-100 (manufactured by UNITKA LTD.) in 22 parts of THF.

Figure 3:
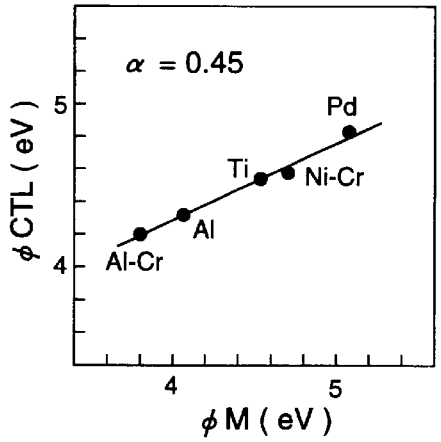
FIGS. 3(*a*) to 3(*c*) show graphs illustrating the relationship between the work function $\phi_{CTL}$ of the charge transport layer and the work function $\phi_M$ of the sample electrode.
Figure 3:
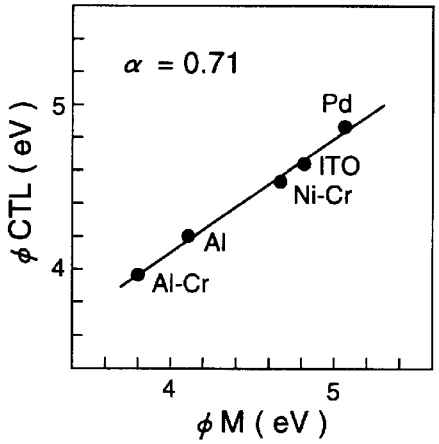
Figure 3:
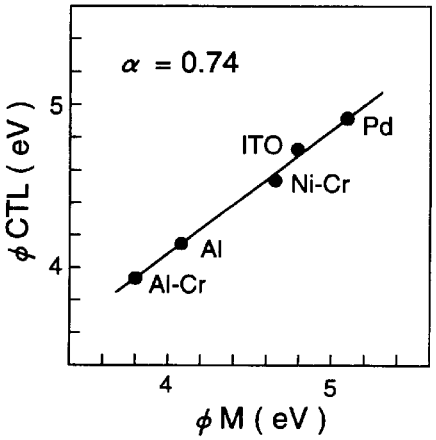

With the use of the resulting solutions, the contact potential differences of the charge transport layer were measured. Each relationship between the obtained work function $\phi_{CTL}$ and the work function $\phi_M$ of the sample electrode is shown in FIGS. 3(*a*) to 3(*c*).

On the other hand, on an aluminum deposited PET film was arranged an intermediate layer composed of a polyamide resin "CM8000" (manufactured by TORAY INDUSTRIES, INC.) having a thickness of 0.5 μm. On each of the resulting layers, using the charge generation layer coating solution employed in Example 1, a charge generation layer having a thickness of 0.3 μm was formed. On the charge generation layer, the above-mentioned charge transport layer coating solution was then coated using a doctor blade and dried, and a photoreceptor sample was prepared by forming a charge transport layer having a thickness of 18 μm. The samples were termed 2a to 2c, respectively. The resulting photoreceptor samples were evaluated according to the Evaluation 1. The results are shown in Table 2.

TABLE 2

| Sample | α of Charge Transport Layer | $V_i$ (V) | $V_r$ (V) |
|---|---|---|---|
| Sample 2a | 0.45 | 776 | 10 |
| Sample 2b | 0.71 | 984 | 231 |
| Sample 2c | 0.74 | 960 | 185 |

According to FIGS. 3(*a*) to 3(*c*) and the results in Table 2, in the only case of (A-59), the gradient of the work function plotting is 0.6 or less and the remarkable decrease in the residual potential of the photoreceptor is confirmed.

Example 3

A charge transport layer coating solutions was prepared by dissolving 1 part of each of electron transport materials (A-11), (A-17), (B-13), (A-27) and (A-53) and 1.3 parts of polycarbonate resin "IUPILON Z-200" in 7 parts of THF.

Figure 4:
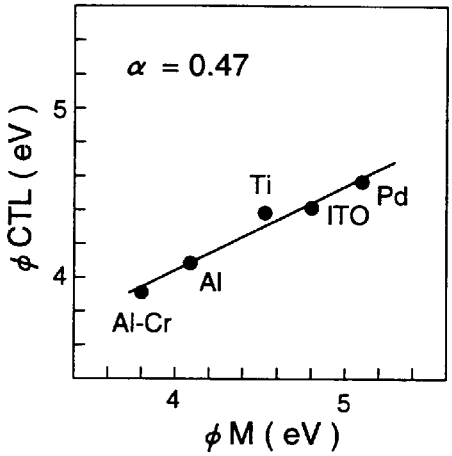
FIGS. 4(*a*) to 4(*e*) show graphs illustrating the relationship between the work function $\phi_{CTL}$ of the charge transport layer and the work function $\phi_M$ of the sample electrode.
Figure 4:
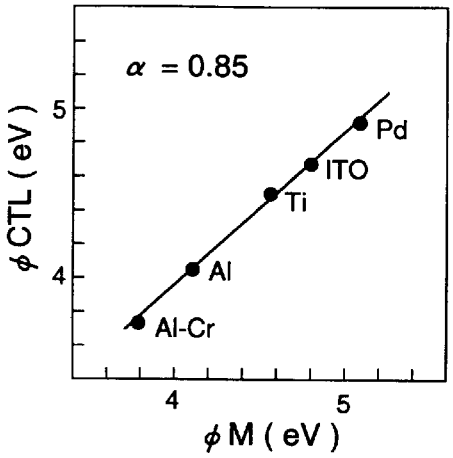
Figure 4:
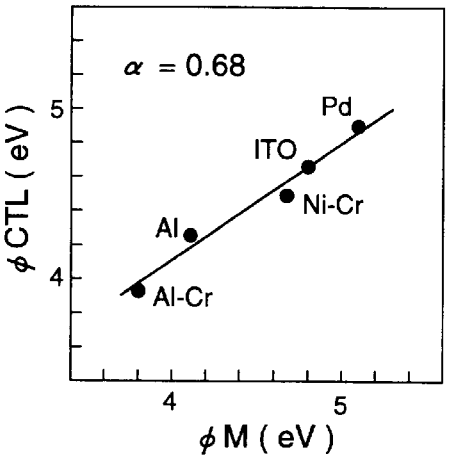
Figure 4:
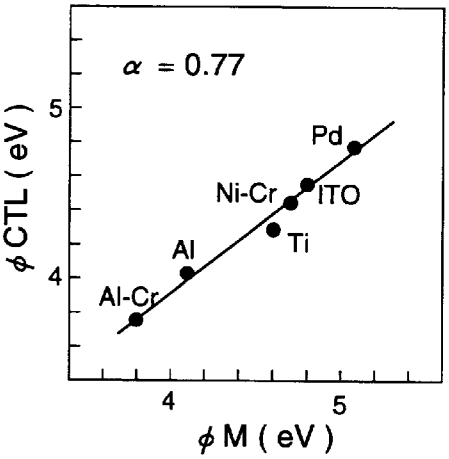
Figure 4:
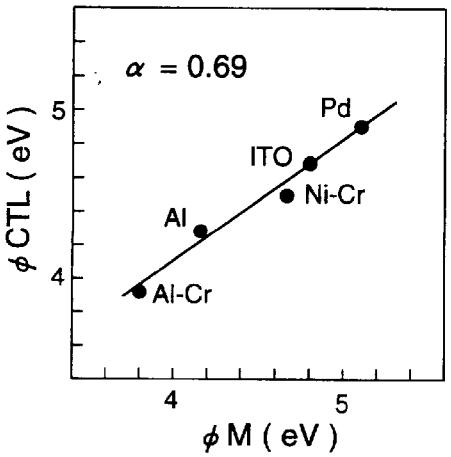

With the use of the resulting solutions, the contact potential differences of the charge transport layer were measured. Relationships between the obtained work function $\phi_{CTL}$ and the work function $\phi_M$ of the sample electrode are shown in FIGS. 4(*a*) to 4(*e*), respectively.

On the other hand, on an aluminum deposited PET film, using the charge generation layer coating solution employed in Example 1, was formed a charge generation layer having a thickness of 0.3 μm. On the charge generation layer, the above-mentioned charge transport layer coating solution was then coated using a doctor blade and dried, and photoreceptor samples were prepared by forming a charge transport layer having a thickness of 17 μm. The samples were termed 3a to 3e, respectively. Obtained photoreceptor samples were evaluated according to the Evaluation 1. The results are shown in Table 3.

TABLE 3

| Sample | α of Charge Transport Layer | $V_i$ (V) | $V_r$ (V) |
|---|---|---|---|
| Sample 3a | 0.47 | 903 | 7 |
| Sample 3b | 0.85 | 911 | 86 |
| Sample 3c | 0.68 | 890 | 81 |
| Sample 3d | 0.77 | 974 | 153 |
| Sample 3e | 0.69 | 930 | 197 |

According to FIGS. 4(*a*) to 4(*e*) and the results in Table 3, in the only case of (A-11), the gradient of the work function plotting is 0.6 or less and the remarkable decrease in the residual potential of the photoreceptor is confirmed.

Example 4

Figure 5:
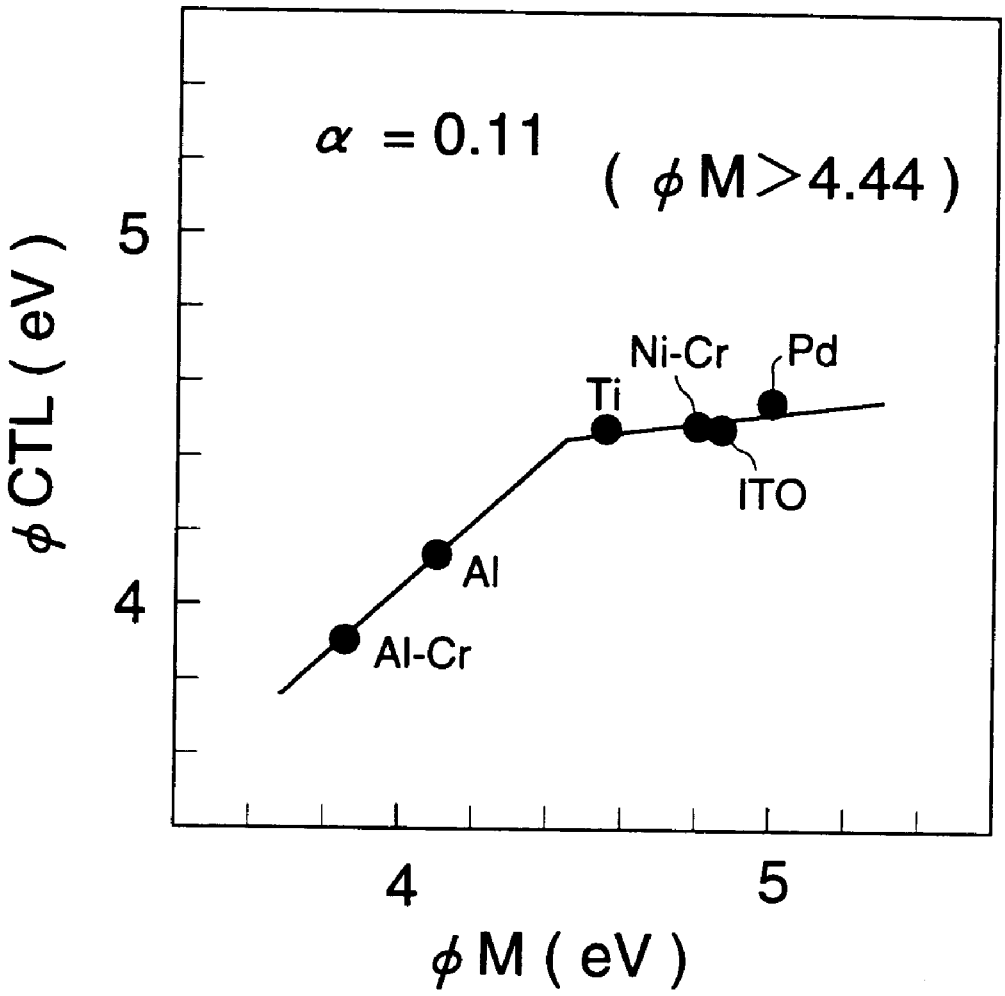
FIG. 5 shows a graph illustrating the relationship between the work function $\phi_{CTL}$ of the charge transport layer and the work function $\phi_M$ of the sample electrode.

A charge transport layer coating solution was prepared by dissolving 1.3 part of a polycarbonate resin "IUPILON Z-200 (manufactured by MITSUBISHI GAS CHEMICAL CO., INC.) in 7 parts of THF. With the use of the resulting solution, the contact potential difference of the charge transport layer was measured. Plotting the obtained work functions is shown in FIG. 5. In the range where the work function $\phi_M$ of the electrode exceeds 4.44 eV, $\alpha$=0.11 was obtained.

As an electrode was then utilized each of palladium (Pd $\phi_M$=0.5 eV) and indium tin oxide (ITO $\phi_M$=4.8 eV) in which $\phi_M$ exceeds 4.44 eV, and aluminum (Al $\phi_M$=4.1 eV) and aluminum-chromium alloy (Al-Cr $\phi_M$=3.8 eV) in which $\phi_M$ is 4.44 eV or less, and electrophotoreceptors were prepared according to the following procedures.

On a polyethylene terephthalate (PET) film on which each metal had been deposited, was arranged an intermediate layer having a thickness of 0.4 mm, which was composed of polyamide resin "CM8000" (manufactured by TORAY INDUSTRIES INC.) On the resulting layer, was coated using a wire bar a dispersion which was prepared by dispersing on a sand mill a mixture consisting of 1 part of titanylphthalocyanine having peaks at 9.5°, 24.1° and 27.2° of Bragg angle 2θ in the X-ray diffraction, 0.5 part of silicone-butyral resin and 50 parts of methyl isopropyl ketone as a dispersion medium, and a charge generation layer having a thickness of 0.3 μm was prepared. On the charge generation layer, the above-mentioned charge transport layer coating solution was then coated using a doctor blade and dried to form a charge transport layer having a thickness of 21 μm. Each photoreceptor of the palladium electrode, of the ITO electrode, of the aluminum electrode and of the aluminum-chromium alloy electrode was termed samples 4a, 4b, 4c and 4d, respectively.

Evaluation 2

The evaluation on the electrophotoreceptor was conducted using the Electrostatic Copying Test Apparatus "EPA-8100" (manufactured by Kawaguchi Denki Co., Ltd.). At first, the sample was subjected to +6 kV corona charging. After being left alone for 5 seconds in the dark, the surface potential Vi (V) was obtained. The sample was then exposed to a white light having an illumination intensity of 10 lux for 10 seconds and further to a light of 200 lux for 2 seconds and the surface potential was measured as residual potential Vr (V). This operation was continuously repeated 200 times and the increase ΔVi (V) in the charge potential and the increase ΔVr (V) of residual potential were then obtained.

Photoreceptor samples obtained above were evaluated according to the Evaluation 2. The results are shown in Table 4.

TABLE 4

| Sample | Electrode | ϕM (eV) | Vi (V) | Vr (V) | Δvi (V) | Δvr (V) |
|---|---|---|---|---|---|---|
| Sample 1a | Palladium | 5.0 | 965 | 0 | +8 | 0 |
| Sample 1b | ITO | 4.8 | 960 | 0 | +9 | 0 |
| Sample 1c | Aluminum | 4.1 | 991 | 18 | +55 | +60 |
| Sample 1d | Aluminum-chromium | 3.8 | 1026 | 24 | +73 | +87 |

With the plotting of the work functions, in the combination of the charge transport layer with the electrode in the region of $\alpha \leqq 0.2$, the residual potential becomes zero and almost no increase in the potential due to the repetition is confirmed.

Example 5

Figure 6:
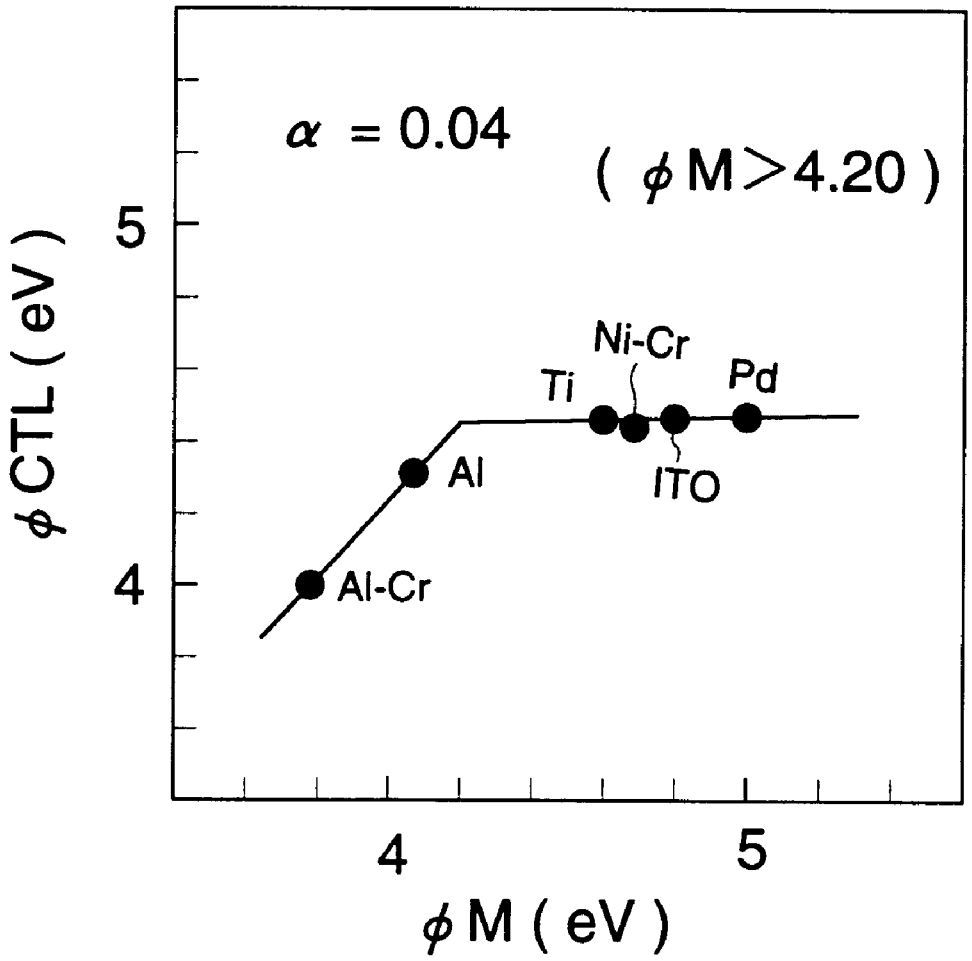
FIG. 6 shows a graph illustrating the relationship between the work function $\phi_{CTL}$ of the charge transport layer and the work function $\phi_M$ of the sample electrode

A charge transport layer coating solution was prepared by dissolving 1 part of polystyrene resin "STYRON 679" (manufactured by ASAHI DAU INDUSTRY CO., LTD.) and 0.05 part of the additive compound (Z-1) into 7 parts of THF. With the use of the resulting solution, the contact potential difference of the charge transport layer was measured. Plotting the obtained work functions is shown in FIG. 6. In the region wherein the work function $\phi_M$ of the electrode exceeds 4.20 eV, $\alpha$=0.04 was obtained.

An electrophotoreceptor was then prepared in the same manner as in Example 4 except that the charge transport layer coating solution was changed in such a way that each of palladium (Pd $\phi_M$=0.5 eV) and indium tin oxide (ITO $\phi_M$=4.8 eV) in which $\phi_M$ exceeds 4.20 eV, and aluminum (Al $\phi_M$=4.1 eV) and aluminum-chromium alloy (Al-Cr $\phi_M$=3.8 eV) in which $\phi_M$ is 4.20 eV or less was employed as an electrode. The photoreceptor of which electrode was palladium was termed Sample 5a, the photoreceptor of which electrode was ITO was termed Sample 5b, the photoreceptor of which electrode was aluminum was termed Sample 5c and the photoreceptor of which electrodes was aluminum-chromium alloy was termed Sample 5d.

Z-1

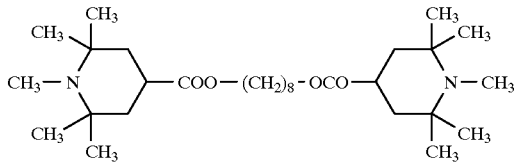
CH3
CH3
CH3

2. The electrophotoreceptor of claim 1, wherein the photoreceptive layer contains a charge generation material and the electron transporting charge transport material in admixture.

3. The electrophotoreceptor of claim 1, wherein the photoreceptive layer comprises a charge generation layer containing a charge generation material and the charge transport layer containing an electron transporting charge transport material provided in a layered structure on the substrate.

4. The electrophotoreceptor of claim 3, wherein the charge generation layer and the charge transport layer are provided in that order on the substrate.

5. The electrophotoreceptor of claim 1, wherein the electron transporting charge transport material is a compound represented by the following formula (A), (B), (C) or (D):

General formula (A)

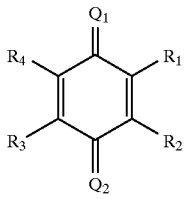

General formula (B)

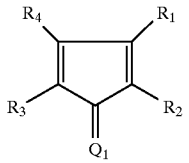

General formula (C)

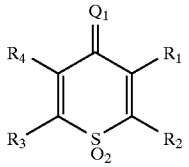

General formula (D)

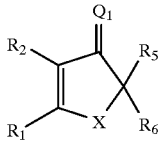

wherein X represents $>SO_2$ or $>C{=}Q_2$; $Q_1$ and $Q_2$ independently represent $=O$, $=S$, $=N-R_7$ or $=C(Z_1)(Z_2)$; $R_1$, $R_2$, $R_3$, $R_4$, $R_5$, $R_6$and $R_7$ independently represent a hydrogen atom, a halogen atom, a cyano group, a substituted vinyl group, an alkyl group, an aryl group or a heterocyclic group, provided that $R_1$ and $R_2$, and $R_3$ and $R_4$ each combination may combine with each other to form an aromatic ring or an aliphatic ring, and $R_5$ and $R_6$ together may form $=N-R_7$ or $=C(R_8)(R_9)$ in which $R_8$ and $R_9$ independently represent a hydrogen atom, halogen, cyano, a substituted vinyl group, an alkyl group, an aryl group or a heterocyclic group; and $Z_1$ and $Z_2$ independently represent an electron attractive group.

6. An electrophotoreceptor comprising a conductive substrate and provided thereon, a photoreceptive layer comprising a charge generation material, an organic electron transport material and a binder, wherein a layer transporting charge satisfies inequality $\alpha \leqq 0.2$ in a specific range of $\Phi_M$, said $\alpha$ being a gradient of a straight line represented by the following formula (a):

$$\Phi_{CTL}=\alpha\cdot\Phi_M+\beta \quad (a)$$

wherein $\Phi_{CTL}$ represents work function of the layer transporting charge alone obtained by measuring a contact potential difference of the layer transporting charge on a conductive electrode material; $\Phi_M$ represents work function of the conductive electrode material; and $\beta$ is a constant.

7. The electrophotoreceptor of claim 6, wherein the photoreceptive layer contains a charge generation material and the electron transporting charge transport material in admixture.

8. The electrophotoreceptor of claim 6, wherein the photoreceptive layer comprises a charge generation layer containing a charge generation material and the charge transport layer containing an electron transporting charge transport material provided in a layered structure on the substrate.

9. The electrophotoreceptor of claim 8, wherein the charge generation layer and the charge transport layer are provided in that order on the substrate.

10. The electrophotoreceptor of claim 1, wherein the layer transporting charge has a work function satisfying inequality $\alpha \leqq 0.6$ in the $\Phi_M$ range of 3.6 to 6.0 (eV).

11. The electrophotoreceptor of claim 1, wherein the conductive substrate is made of a metal having $\Phi_M$ of 3.6 to 6.0 (eV).

12. The electrophotoreceptor of claim 6, wherein the layer transporting the charge has a work function satisfying inequality $\alpha \leqq 0.6$ in the $\Phi_M$ range of 3.6 to 6.0 (eV).

13. The electrophotoreceptor of claim 6, wherein the conductive substrate is made of a metal having $\Phi_M$ of 3.6 to 6.0 (eV).

* * * * *